US007436294B2

(12) United States Patent
Saga et al.

(10) Patent No.: US 7,436,294 B2
(45) Date of Patent: Oct. 14, 2008

(54) METHOD AND APPARATUS FOR DISASTER PREVENTION

(75) Inventors: Susumu Saga, Kawasaki (JP); Yasuyuki Kawaida, Kawasaki (JP); Hiroko Kaneko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 66 days.

(21) Appl. No.: 11/193,454

(22) Filed: Aug. 1, 2005

(65) Prior Publication Data

US 2006/0226970 A1 Oct. 12, 2006

(30) Foreign Application Priority Data

Apr. 12, 2005 (JP) ..... 2005-114908

(51) Int. Cl.
*G08B 29/00* (2006.01)

(52) U.S. Cl. ..... 340/506; 340/539.1; 340/539.11; 340/539.13; 340/825.36; 340/825.49; 340/524; 340/525

(58) Field of Classification Search ..... 340/506, 340/539.1, 539.11, 539.22, 539.26, 3.1, 539.13, 340/825.36, 825.49, 524, 525
See application file for complete search history.

(56) References Cited

U.S. PATENT DOCUMENTS 6,084,510 A * 7/2000 Lemelson et al. ..... 340/539.13
6,114,948 A * 9/2000 Astell ..... 340/332
6,529,128 B2 * 3/2003 Weng ..... 340/539.1
6,608,559 B1 * 8/2003 Lemelson et al. ..... 340/539.13
6,759,956 B2 * 7/2004 Menard et al. ..... 340/539.19
6,822,555 B2 * 11/2004 Mansfield, Jr. et al. . 340/538.11
6,873,256 B2 * 3/2005 Lemelson et al. ..... 340/539.1
6,930,596 B2 * 8/2005 Kulesz et al. ..... 340/506
7,026,925 B2 * 4/2006 Roche et al. ..... 340/531
7,026,947 B2 * 4/2006 Faltesek et al. ..... 340/691.1
7,049,952 B2 * 5/2006 Kulesz et al. ..... 340/506
7,053,764 B2 * 5/2006 Stilp ..... 340/506
7,123,126 B2 * 10/2006 Tanaka et al. ..... 340/5.2
7,126,481 B2 * 10/2006 Vesikivi et al. ..... 340/572.4
7,167,082 B2 * 1/2007 Stigall ..... 340/407.1
7,180,415 B2 * 2/2007 Bankert et al. ..... 340/539.17

FOREIGN PATENT DOCUMENTS

JP HEI 6-111172 A 4/1994
JP 2002-298228 A 10/2002
JP 2004-111347 A 4/2004

* cited by examiner

*Primary Examiner*—Daryl C Pope
(74) *Attorney, Agent, or Firm*—Staas & Halsey LLP

(57) ABSTRACT

An apparatus, which is for disaster prevention installed in a facility, includes a radio-frequency identification tag that stores at least one of a first data and a second data. The first data is related to the disaster prevention, and is transmitted by wireless communication. The second data is related to the disaster prevention, and is received by wireless communication.

4 Claims, 5 Drawing Sheets

METHOD AND APPARATUS FOR DISASTER PREVENTION

BACKGROUND OF THE INVENTION

1. Field of the Invention

The present invention relates to a technology for providing data related to disaster prevention to an evacuee, a firefighter, and the like.

2. Description of the Related Art

Evacuation guiding lights (hereinafter, "guide lights") are typically installed throughout a public facility such as a hotel or an underground shopping arcade. In the event of an emergency such as a fire, the guide lights guide people to an escape path or an escape gate so that they are safely evacuated.

However, a predetermined escape path is not always the safest path. If a fire breaks out near the escape path, it needs to be changed to avoid the fire.

One approach is to provide a host computer that collects data indicating a status of the fire. The host computer determines an optimal escape path based on the data collected, and displays the escape path on screens set in the facility so that people are safely evacuated (refer to Japanese Patent Application Laid-Open No. H6-111172).

In another approach, instead of compiling the data at the host computer, a plurality of devices is provided throughout the facility. Each device determines a status of a fire in an area surrounding the device, and activates a guide light based on the determination (refer to Japanese Patent Application Laid-Open No. 2002-298228).

However, the conventional technology can only show an escape path, and cannot provide further details to evacuees, firefighters, or maintenance persons of disaster prevention equipment. Moreover, installation of the conventional system entails high-cost because special devices are used.

Thus, there is a need for a low-cost system that can efficiently provide information to evacuees, firefighters, etc., to prevent a disaster.

SUMMARY OF THE INVENTION

An apparatus according to an aspect of the present invention, which is an apparatus for disaster prevention installed in a facility, includes a radio-frequency identification tag that stores at least one of a first data and a second data. The first data is related to the disaster prevention, and is transmitted by wireless communication. The second data is related to the disaster prevention, and is received by wireless communication.

A data-management system according to another aspect of the present invention, which is a data-management system for disaster prevention installed in a facility, includes: a radio-frequency identification tag that is attached to a disaster-prevention apparatus and stores data that is related to the disaster prevention and is transmitted by wireless communication; and a data reading unit that reads the data from the radio-frequency identification tag.

A method according to still another aspect of the present invention, which is a method for managing data related to disaster prevention installed in a facility, includes: storing data related to the disaster prevention in a radio-frequency identification tag by wireless communication; and reading the data from the radio-frequency identification tag.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
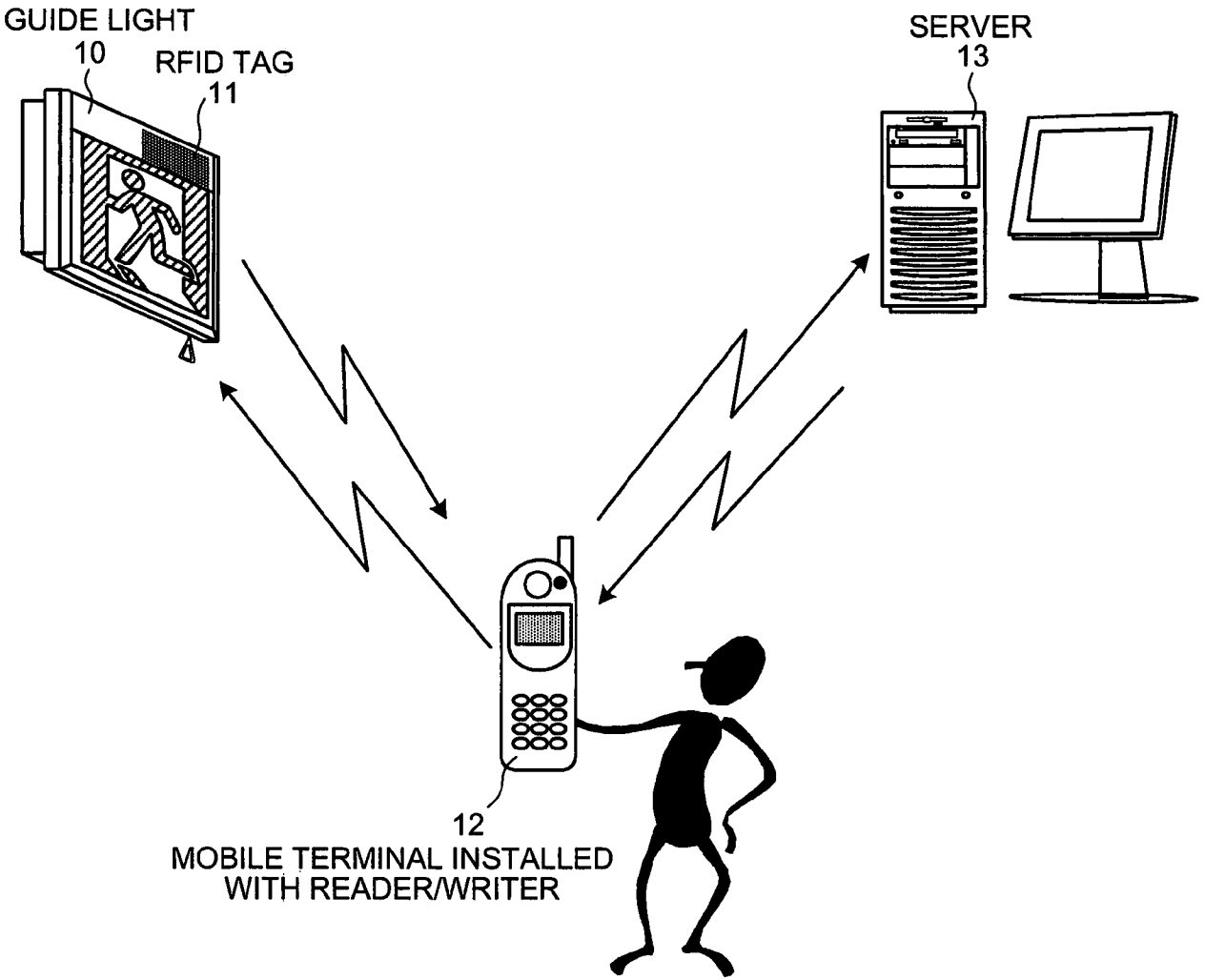
FIG. 1 is a conceptual diagram of a disaster-prevention-data management processing according to an embodiment of the present invention.

FIG. 1 is a conceptual diagram of a disaster-prevention-data management processing according to an embodiment of the present invention. A radio-frequency identification (RFID) tag 11 is attached to an evacuation guiding light (hereinafter, "guide light") 10. Various data related to disaster prevention (hereinafter, disaster-prevention data) is stored in the RFID tag 11.

A plurality of guide lights 10 is installed at various locations throughout a facility such as a hotel or an underground shopping arcade, etc. In the event of an emergency such as a fire, the guide lights 10 guide people so that they are safely evacuated. The RFID tag 11 is a wireless integrated circuit (IC) tag that includes a memory for storing data, an antenna for performing wireless communication, and a control circuit.

Instead of being attached to the guide light 10, the RFID tag 11 can be attached to any other disaster prevention equipment such as a temperature sensor, a humidity sensor, a smoke-emission sensor, or a sprinkler used for fire extinction.

In the disaster-prevention-data management processing, evacuees and firefighters each holds a mobile terminal installed with a reader/writer (hereinafter, "mobile terminal") 12. The mobile terminal 12 performs wireless communication with the RFID tag 11 and a server 13 to store/read data.

Moreover, the mobile terminal 12 displays data received from another device on a built-in screen. The mobile terminal 12 can be a mobile phone, a personal handyphone system (PHS), a transceiver, a personal digital assistant (PDA), and so forth.

The disaster-prevention data includes data of a location of the guide light 10, temperature, humidity, presence/absence of smoke emission, an operation status of disaster prevention equipment, a communication record of the mobile terminal 12, maintenance/management of disaster prevention equipment, an escape path, a present location of the mobile terminal 12, and so forth.

A location of the guide light 10 means the location where the guide light 10 is installed. A temperature sensor, a humidity sensor, and a smoke-emission sensor detect temperature, humidity, and smoke emission, respectively. These sensors transmit data to the RFID tag 11 by wireless electric waves.

The operation status of disaster prevention equipment indicates whether the guide light 10 or a sensor is operating.

The communication record of the mobile terminal 12 indicates the communication record between the mobile terminal 12 and the RFID tag 11. Specifically, the mobile terminal 12 stores time of communication and identification data of an owner of the mobile terminal 12 into the RFID tag 11.

When a fire breaks out, a firefighter reads the data stored in the RFID tag 11 with the mobile terminal 12 to grasp who passed by a particular guide light 10 at what time.

Data of maintenance/management of disaster prevention equipment includes information on the guide light 10 and a sensor, such as a date of manufacture, a failure or a breakdown record, a repair record, and so forth.

When maintenance is performed on the guide light 10 or a sensor, a maintenance person reads such data from the RFID tag 11 with the mobile terminal 12.

Data of an escape path include a direction, a distance to an escape gate, and so forth. An evacuee can easily find an escape path by reading such data from the RFID tag 11 with the mobile terminal 12.

Data of the present location of the mobile terminal 12 indicates a location of each mobile terminal 12 that communicated with the RFID tag 11. This data is obtained from the location of the guide light 10 and the communication record of the mobile terminal 12.

Specifically, the server 13 searches the last RFID tag 11 with which the mobile terminal 12 communicated, by referring to the communication record stored in the RFID tag 11. Subsequently, the server 13 identifies the location of the guide light 10 to which the searched RFID tag 11 is attached, so as to find the location of the owner of the mobile terminal 12.

The server 13 acquires data from the mobile terminal 12, manages and analyzes the data, and uses the data to monitor the facility installed with the guide lights 10.

The server 13 sends results of the data analysis to the mobile terminal 12. An evacuee or a firefighter can view the data analysis results received at the mobile terminal 12.

Then, the mobile terminal 12 sends the data analysis results to the RFID tag 11, and the RFID tag 11 stores the data analysis results. Accordingly, other mobile terminals 12 can read the data analysis results from the RFID tag 11.

Figure 2:
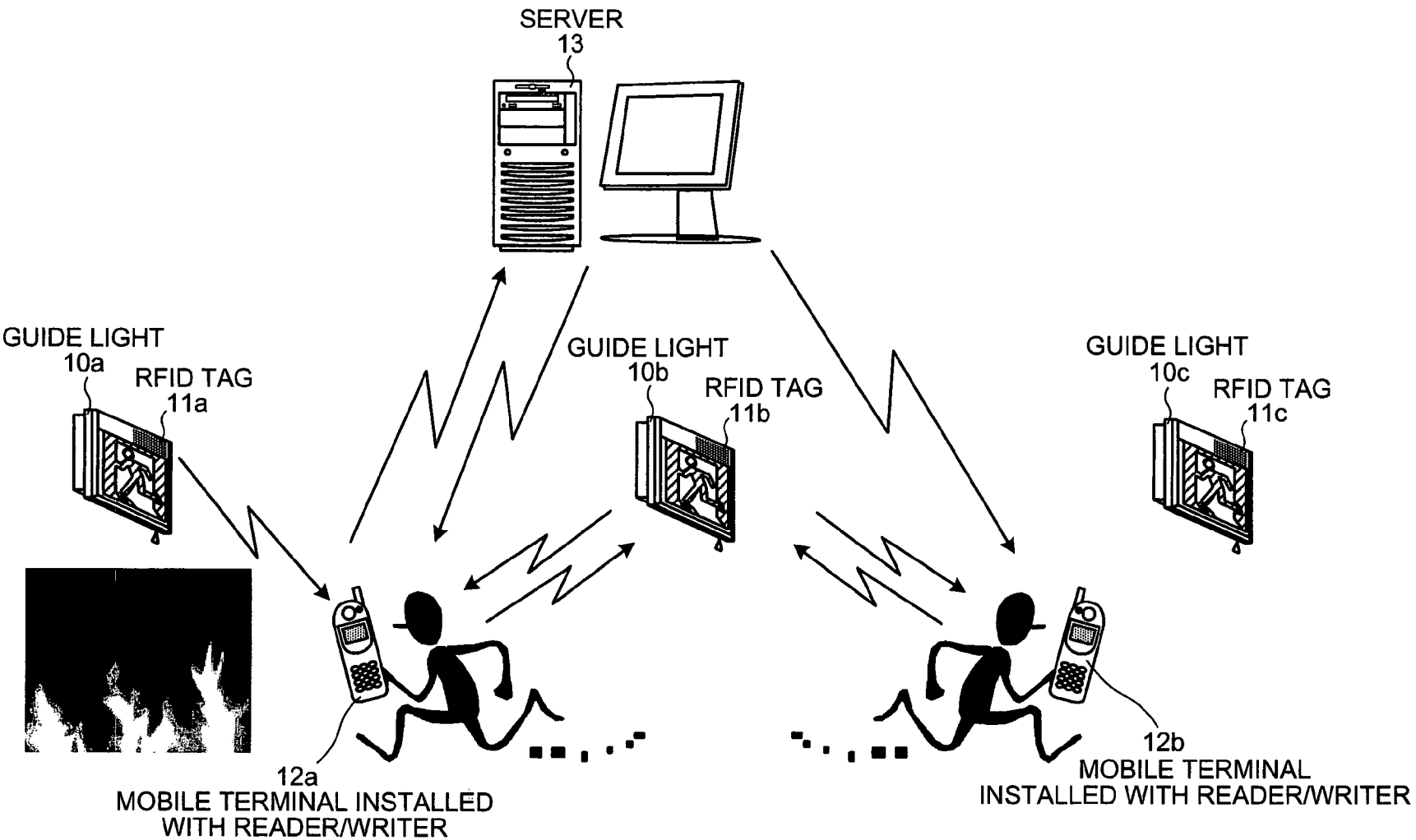
FIG. 2 is a conceptual diagram of the disaster-prevention-data management processing performed when a fire breaks out.

FIG. 2 is a conceptual diagram of the disaster-prevention-data management processing performed when a fire breaks out. When a fire breaks out near a guide light 10*a*, the temperature sensor, the humidity sensor, and the smoke-emission sensor stores data of temperature, humidity, and smoke emission into an RFID tag 11*a* attached to the guide light 10*a*.

A mobile terminal 12*a* held by an evacuee or a firefighter near the guide light 10*a* reads data stored in the RFID tag 11*a*, and sends the data to the server 13. The data includes location of the guide light 10*a*, temperature, humidity, smoke emission, a communication record of the mobile terminal 12*a*, and so forth.

The RFID tag 11*a* can be an active RFID tag that periodically sends data to the mobile terminal 12*a*, or a passive RFID tag that sends data to the mobile terminal 12*a* in response to requests that are periodically received from the mobile terminal 12*a*.

An active RFID tag performs wireless communication and thus consumes electric power. However, if the RFID tag 11*a* is attached to the guide light 10*a* including an uninterruptible power source, the active RFID tag can operate stably even in the event of an emergency.

Moreover, regardless of whether the RFID tag is active or passive, the RFID tag 11*a* is prevented from being damaged if it is attached inside the guide light 10*a* with a rigid casing.

The server 13 acquires from the mobile terminal 12*a*, data of the location of the guide light 10*a*, temperature, humidity, and smoke emission. Based on the data acquired, the server 13 determines the location of the fire breakout. The server 13 sends to the mobile terminal 12*a* held by a firefighter, data indicating a path to the location of the fire breakout.

When this data is received, the mobile terminal 12*a* displays on a built-in screen the path to the location of the fire breakout, and stores the location of the fire breakout in an RFID tag 11*b* attached to another guide light 10*b*.

If the location of the fire breakout is near the escape path initially set, the server 13 sets a new escape path. The server 13 then sends to a mobile terminal 12*b* held by an evacuee, data indicating the new escape path (e.g. "escape towards a guide light 10*c*").

When this data is received, the mobile terminal 12*b* displays on a built-in screen the new escape path, and stores the data in the RFID tags 11*b*, 11*c* attached to the other guide lights 10*b*, 10*c*.

Moreover, based on the data acquired from the mobile terminal 12*a*, the server 13 determines a status of fire extinction. The server 13 sends to the mobile terminal 12*a*, 12*b* held by an evacuee or a firefighter, data indicating the status of fire extinction.

Furthermore, the server 13 identifies present locations of each mobile terminal 12*a*, 12*b* that communicated with any RFID tag 11*a* to 11*c*.

Specifically, the server 13 searches the last RFID tag 11*a* to 11*c* that each mobile terminal 12*a*, 12*b* communicated with by referring to the communication record of each mobile terminal 12*a*, 12*b* stored in the RFID tag 11*a* to 11*c*. Subsequently, the server 13 identifies the location of the guide light 10*a* to 10*c* to which the searched RFID tag 11*a* to 11*c* is attached, to find the location of the owner of the mobile terminal 12*a*, 12*b*. This data is sent to each of the mobile terminals 12*a*, 12*b*.

When the data is received, the mobile terminal 12*a*, 12*b* displays the data on a built-in screen, and stores the data in the RFID tag 11*a* to 11*c*.

When a fire breaks out, the server 13 can send data of the fire to a fire monitoring device (not shown) at a fire station through a network. Moreover, the fire monitoring device can notify the fire to a fire engine, and instruct the fire engine to rush to the site of the fire.

Furthermore, the server 13 can send through a network, data of the fire to a control system (not shown) that controls a fire door. Accordingly, the control system operates the fire door to prevent the fire from spreading.

In the disaster-prevention-data management processing, various data of the fire is stored in the low-cost RFID tag 11, so that evacuees, firefighters, and maintenance persons of disaster prevention equipment can read the data with the mobile terminal 12. Accordingly, the disaster-prevention-data management processing system can be installed at low cost, and data of the fire can be provided efficiently to evacuees, firefighters, and maintenance persons of disaster prevention equipment.

Figure 3:
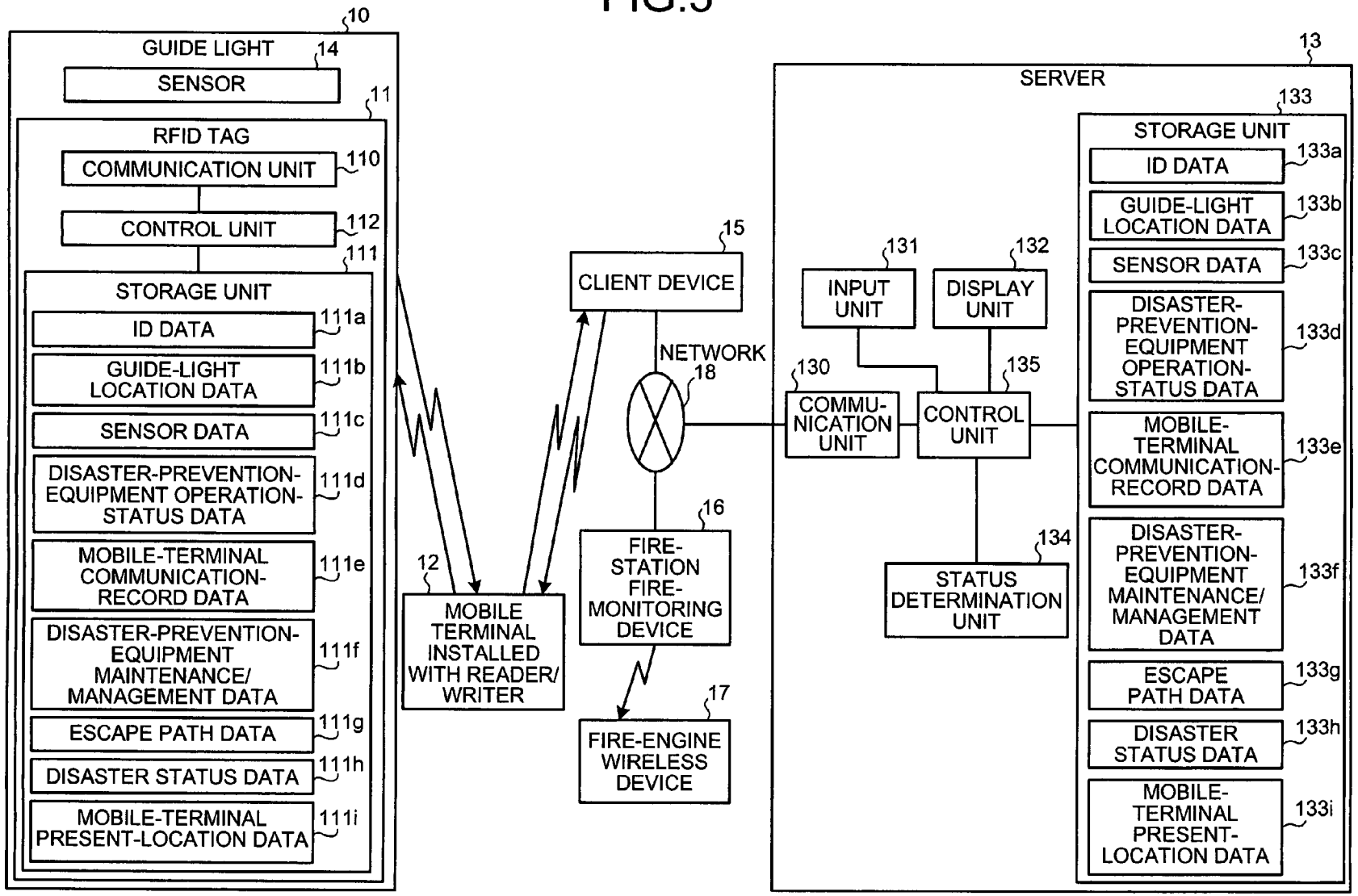
FIG. 3 is a block diagram of a disaster-prevention-data management system according to the embodiment.

FIG. 3 is a block diagram of a disaster-prevention-data management system according to the embodiment of the present invention.

The block diagram of a disaster-prevention-data management system includes the guide light 10, the RFID tag 11 attached to the guide light 10, the mobile terminal 12, the server 13, a sensor 14, a client device 15, a fire-station fire-monitoring device 16, a fire-engine wireless device 17.

The guide light 10 and the RFID tag 11 are the same as those shown in FIG. 1. The sensor 14 is provided in the guide light 10, and detects temperature, humidity, presence/absence of smoke emission, and so forth.

The guide light 10 and the sensor 14 include a device (not shown) that sends to and stores in the RFID tag 11, data indicating whether the guide light 10 and the sensor 14 are operating.

The RFID tag 11 includes a communication unit 110, a storage unit 111, and a control unit 112. The communication unit 110 performs wireless communication between the guide light 10, the sensor 14, and the mobile terminal 12. The storage unit 111 stores data received from the guide light 10, the sensor 14, and the mobile terminal 12.

Specifically, the storage unit 111 stores ID data 111*a*, guide-light location data 111*b*, sensor data 111*c*, disaster-prevention-equipment operation-status data 111*d*, mobile-terminal communication-record data 111*e*, disaster-prevention-equipment maintenance/management data 111*f*, escape path data 111*g*, disaster status data 111*h*, and mobile-terminal present-location data 111*i*.

The ID data 111*a* identifies the RFID tag 11. The guide-light location data 111*b* is a position coordinate of the guide light 10 attached with the RFID tag 11.

The sensor data 111*c* is data acquired by the sensor 14, such as temperature, humidity, and presence/absence of smoke emission. The disaster-prevention-equipment operation-status data 111*d* shows whether the guide light 10 and the sensor 14 are operating. The RFID tag 11 acquires this data by communicating with the guide light 10 and the sensor 14.

The mobile-terminal communication-record data 111*e* is acquired as follows. When the RFID tag 11 and the mobile terminal 12 communicate with each other, ID data identifying the owner of the mobile terminal 12 is sent to the RFID tag 11. The RFID tag 11 stores time of the communication with the corresponding ID data.

When a fire breaks out, a firefighter reads the mobile-terminal communication-record data 111*e* with his mobile terminal 12 to grasp who passed by a particular guide light 10 at what time.

The disaster-prevention-equipment maintenance/management data 111*f* is information on the guide light 10 and the sensor 14, such as a date of manufacture, a failure or a breakdown record, a repair record, and so forth. The disaster-prevention-equipment maintenance/management data 111*f* is updated with the mobile terminal 12 every time maintenance is performed on the guide light 10 or the sensor 14.

The escape path data 111*g* is data of a predetermined escape path to be used in the event of an emergency. For example, the data shows a direction from a location of the guide light 10 to an escape gate. The escape path data 111*g* is updated with the mobile terminal 12 each time the facility is renovated, or according to a location of a fire breakout.

The disaster status data 111*h* indicates a location of a fire breakout and a status of fire extinction, etc. This data is determined by the server 13, and sent to the RFID tag 11 via the mobile terminal 12.

The mobile-terminal present-location data 111*i* indicates present locations of each mobile terminal 12 that communicated with the RFID tag 11. This data is determined by the server 13, and sent to the RFID tag 11 via the mobile terminal 12.

The control unit 112 controls all the units of the RFID tag 11, and commands data transfer between the units.

The mobile terminal 12 stores ID data that identifies an owner of the mobile terminal 12, and sends the ID data to the RFID tag 11 or the server 13.

The server 13 acquires the data 111*a* to 111*f* stored in the storage unit 111 from each RFID tag 11 attached to the guide lights 10 located throughout the facility, manages and analyzes the data, and uses the data to monitor the facility.

The server 13 includes a communication unit 130, an input unit 131, a display unit 132, a storage unit 133, a status determination unit 134, and a control unit 135.

The communication unit 130 communicates with the client device 15 and the fire-station fire-monitoring device 16 through a network 18. The input unit 131 is an input device such as a keyboard or a mouse. The display unit 132 is a display device such as a screen.

The storage unit 133 is a hard disk device etc., that stores ID data 133*a*, guide-light location data 133*b*, sensor data 133*c*, disaster-prevention-equipment operation-status data 133*d*, mobile-terminal communication-record data 133*e*, disaster-prevention-equipment maintenance/management data 133*f*, escape path data 133*g*, disaster status data 133*h*, and mobile-terminal present-location data 133*i*.

The ID data 133*a* identifies the RFID tags 11 attached to each guide light 10. The guide-light location data 133*b* stores position coordinates of each guide light 10 attached with the RFID tag 11.

The sensor data 133*c* stores data stored in each RFID tag 11 that is acquired by the sensor 14, such as temperature, humidity, and presence/absence of smoke emission, with the ID data 133*a* of the corresponding RFID tag 11.

The disaster-prevention-equipment operation-status data 133*d* stores data stored in each RFID tag 11 as to whether the guide light 10 and the sensor 14 are operating, with the ID data 133*a* of the corresponding RFID tag 11.

The mobile-terminal communication-record data 133*e* is acquired as follows. When the RFID tag 11 and the mobile terminal 12 communicate with each other, ID data identifying an owner of the mobile terminal 12 is sent to the RFID tag 11. The mobile-terminal communication-record data 133*e* stores time of the communication with the ID data 133*a* of the corresponding RFID tag 11 and the ID data of the corresponding mobile terminal 12.

The disaster-prevention-equipment maintenance/management data 133*f* stores information stored in each RFID tag 11 regarding the guide light 10 and the sensor 14, such as a date of manufacture, a failure or a breakdown record, a repair record, and so forth, with the ID data 133*a* of the corresponding RFID tag 11. The disaster-prevention-equipment maintenance/management data 133*f* stored in each RFID tag 11 is updated with the mobile terminal 12 whenever maintenance is performed on the guide light 10 or the sensor 14.

The escape path data 133*g* stores data stored in the RFID tag 11 such as a direction from a location of the guide light 10 to an escape gate, with the ID data 133*a* of the corresponding RFID tag 11. The escape path data 133*g* stored in the RFID tag 11 is updated with the mobile terminal 12 each time the facility is renovated, or according to a location of a fire breakout.

The disaster status data 133*h* indicates a location of a fire breakout and a status of fire extinction determined by the server 13.

The mobile-terminal present-location data 133*i* indicates present locations of each mobile terminal 12 that communicated with the RFID tag 11.

The status determination unit 134 determines, based on data acquired from each RFID tag 11, a location of a fire breakout, a status of fire extinction, an optimal escape path, a present location of each mobile terminal 12 that communicated with the RFID tag 11, and so forth. The status determination unit 134 then sends the determined data to the fire-station fire-monitoring device 16 and the mobile terminal 12.

The client device 15 is located in the facility provided with the guide lights 10. The client device 15 performs wireless communication with the mobile terminal 12, and cable communication with the server 13 through the network 18.

Accordingly, the client device 15 relays communication between the mobile terminal 12 held by an evacuee or a firefighter, and the server 13.

The fire-station fire-monitoring device 16 is located at a fire station, and receives a fire notification from the server 13. When the fire notification is received, the fire-station fire-monitoring device 16 notifies the fire to the fire-engine wireless device 17 installed in a fire engine.

Figure 4:
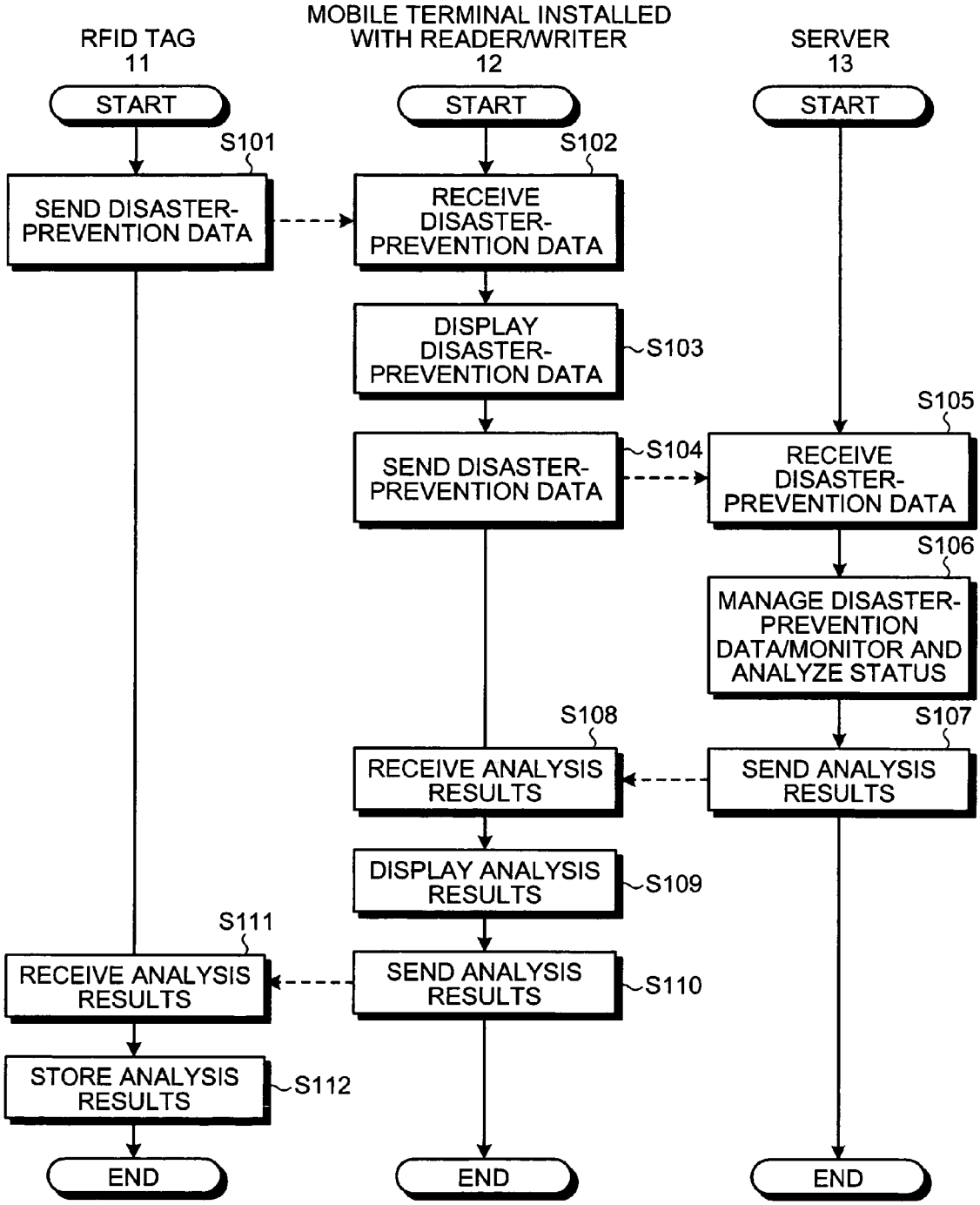
FIG. 4 is a flowchart of the disaster-prevention-data management processing according to the embodiment.

FIG. 4 is a flowchart of the disaster-prevention-data management processing according to the embodiment.

The communication unit 110 in the RFID tag 11 sends to the mobile terminal 12, disaster-prevention data (step S101).

The disaster-prevention data corresponds to the data 111*a* to 111*f* stored in the storage unit 111 in the RFID tag 11 shown in FIG. 3

The mobile terminal 12 receives the data (step S102), displays the data on a built-in screen (step S103), and sends the data to the server 13 (step S104).

The communication unit 130 in the server 13 receives the data from the mobile terminal 12 (step S105).

The storage unit 133 in the server 13 stores and manages the data received. Based on stored data, the status determination unit 134 in the server 13 monitors and analyzes a location of a fire breakout, a status of fire extinction, an optimal escape path, a present location of each mobile terminal 12 that communicated with the RFID tag 11, and so forth (step S106).

The communication unit 130 in the server 13 sends results of the analysis (hereinafter, "results") to the mobile terminal 12 (step S107), and the processing performed by the server 13 ends.

The mobile terminal 12 receives the results from the server 13 (step S108), and displays the results on a built-in screen (step S109).

The mobile terminal 12 sends the results to the RFID tag 11 (step S110), and the processing performed by the mobile terminal 12 ends.

The communication unit 110 in the RFID tag 11 receives the results from the mobile terminal 12 (step S111), and the storage unit 111 in the RFID tag 11 stores the results as the data 111*g* to 111*i* shown in FIG. 3 (step S112), and the processing performed by the RFID tag 11 ends.

In the above example, the mobile terminal 12 is used to write/read data in/from the RFID tag 11. However, a fixed communication terminal installed with a reader/writer located near the guide light 10 can be used to write/read data in/from the RFID tag 11.

Figure 5:
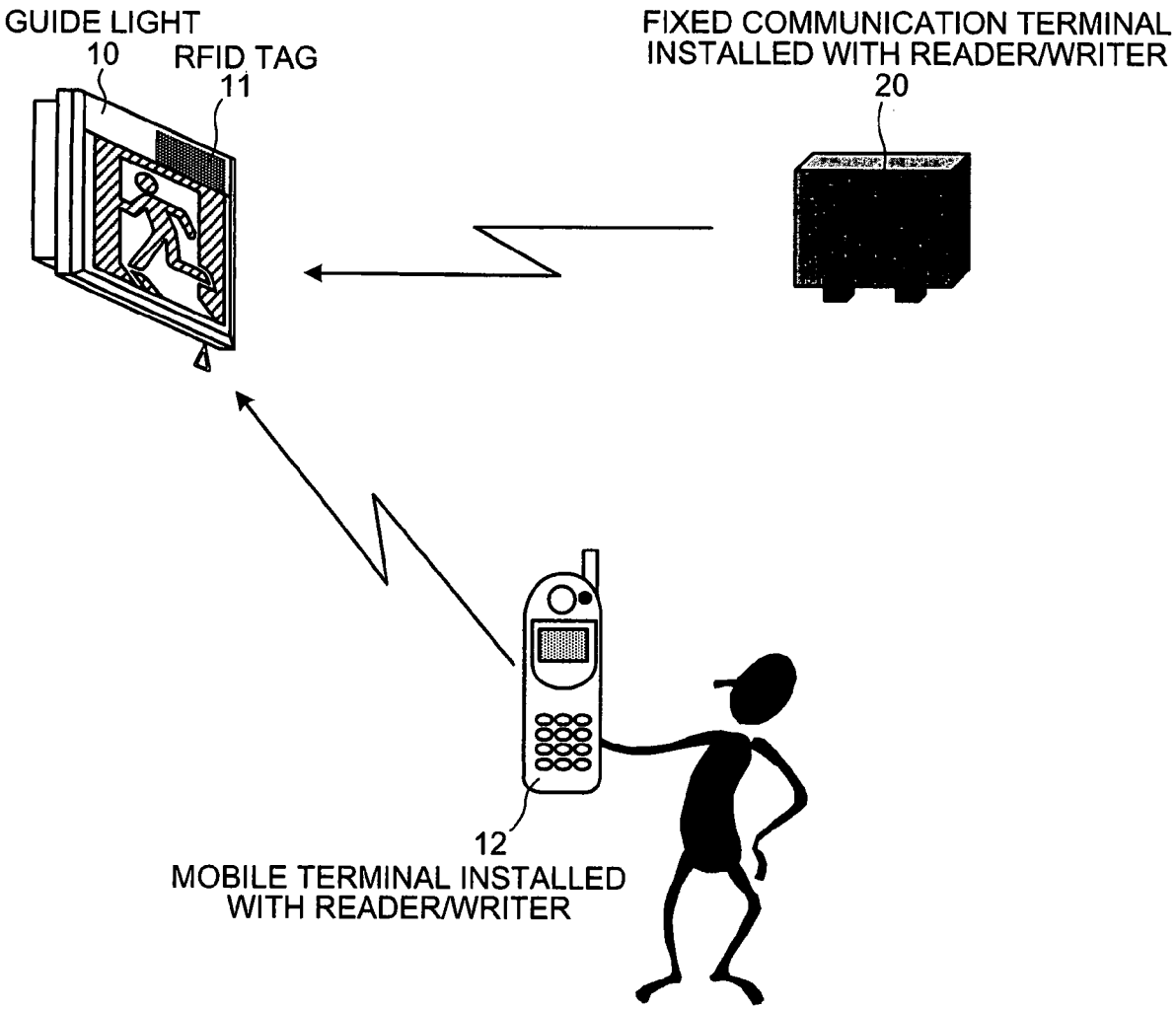
FIG. 5 is a conceptual diagram of the disaster-prevention-data management processing when a fixed communication terminal is located near a guide light.

FIG. 5 is a conceptual diagram of the disaster-prevention-data management processing when a fixed communication terminal installed with a reader/writer (hereinafter, "fixed terminal") 20 is located near the guide light 10. In this example, the disaster-prevention-equipment maintenance/management data 111*f* shown in FIG. 3 is written in the RFID tag 11.

Instead of the mobile terminal 12, the fixed terminal 20 writes the disaster-prevention-equipment maintenance/management data 111*f* in the RFID tag 11 attached to the guide light 10.

The fixed terminal 20 is installed at a fixed location near the guide light 10, and performs wireless communication with the RFID tag 11 to store data in the RFID tag 11 and read data from the RFID tag 11.

The fixed terminal 20 performs wireless communication with the server 13 (shown in FIG. 3) through the client device 15 (shown in FIG. 3) to acquire the disaster-prevention-equipment maintenance/management data 133*f* from the server 13, and to write the acquired disaster-prevention-equipment maintenance/management data 133*f* in the RFID tag 11.

Thus, even when there is nobody holding the mobile terminal 12 near the guide light 10, data can be written into the RFID tag 11 in real-time by using the fixed terminal 20 located near the guide light 10.

According to the embodiment, each of the guide lights 10 installed throughout a facility includes the RFID tag 11 that stores disaster-prevention data, and sends/receives disaster-prevention data by wireless communication. Moreover, RFID tags are inexpensive. Thus, the disaster-prevention-data management system is installed at low cost, and disaster-prevention data is efficiently provided to an evacuee, a firefighter, and a maintenance person of disaster prevention equipment.

According to the embodiment, the RFID tag 11 sends disaster-prevention data to the server 13 by wireless communication. The server 13 analyzes the data received, and determines a status of a disaster based on the analysis. The server 13 then sends the analysis results to the RFID tag 11 by wireless communication, and the RFID tag 11 stores the data. Accordingly, the data stored in the RFID tag 11 is updated when the status of a fire changes. Thus, the latest data is efficiently provided to an evacuee and a firefighter.

According to the embodiment, the RFID tag 11 stores data acquired by the sensor 14 as the disaster-prevention data, and sends the data to the server 13. Thus, the server 13 uses the data received to determine a status of a disaster.

According to the embodiment, the RFID tag 11 stores the guide-light location data 111*b* as the disaster-prevention data. Thus, an evacuee or a firefighter can easily confirm his own location by reading the data.

According to the embodiment, the RFID tag 11 stores the mobile-terminal communication-record data 111*e* that records past communication between the RFID tag 11 and the mobile terminal 12, as the disaster-prevention data. Thus, data as to who passed by a particular guide light 10 at what time can be efficiently provided to a firefighter.

According to the embodiment, the RFID tag 11 stores the disaster-prevention-equipment maintenance/management data 111*f* as the disaster-prevention data. Thus, a maintenance person reads the data to efficiently maintain/manage disaster prevention equipment such as the guide light 10 or the sensor 14.

According to the embodiment, the RFID tag 11 stores the escape path data 111*g* as the disaster-prevention data. Thus, data related to the escape path can be efficiently provided to an evacuee or a firefighter.

According to the embodiment, the RFID tag 11 stores the disaster status data 111*h* as the disaster-prevention data. Thus, data of a location of a fire breakout and a status of fire extinction can be efficiently provided to an evacuee or a firefighter.

According to the embodiment, the RFID tag 11 stores data of a location of each mobile terminal 12 that communicated with the RFID tag 11. Thus, data of locations of owners of each mobile terminal 12 can be efficiently provided to a firefighter.

According to the embodiment, the RFID tag 11 stores disaster-prevention data received by wireless communication, and the mobile terminal 12 reads the data from the RFID tag 11 by wireless communication. Thus, the disaster-prevention-data management system is installed at low cost, and disaster-prevention data is efficiently provided to an evacuee and a firefighter.

According to the embodiment, the server 13 determines a status of a disaster based on data read from the RFID tag 11. Thus, the disaster-prevention-data management system is installed at low cost, and a status of a disaster is efficiently determined with the system.

According to the embodiment, the server 13 sends analysis results of a status of a disaster to the RFID tag 11 by wireless communication, and the RFID tag 11 stores the data. Thus, disaster-prevention data is efficiently provided to an evacuee and a firefighter.

The present invention is not limited to the embodiments described above. Various changes may be made without departing from the scope of the present invention.

All the automatic processes explained in the present embodiment can be, entirely or in part, carried out manually. Similarly, all the manual processes explained in the present embodiment can be entirely or in part carried out automatically by a known method.

The sequence of processes, the sequence of controls, specific names, and data including various parameters can be changed as required unless otherwise specified.

The constituent elements of the devices illustrated are merely conceptual and may not necessarily physically resemble the structures shown in the drawings. For instance, the devices need not necessarily have the structure that is illustrated. The devices as a whole or in parts can be broken down or integrated either functionally or physically in accordance with the load or how the devices are to be used.

The process functions performed by the devices are entirely or partially realized by the CPU or a program executed by the CPU or by a hardware using wired logic.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A data-management system for disaster prevention, the data-management system comprising:

a plurality of radio-frequency identification tags that are installed in a facility, each of the radio-frequency identification tags storing first data that is related to a status of a disaster that occurred in the facility, and a second data that is related to an escape path from the facility;

a data processing apparatus that determines the escape path from the facility based on the first data;

a first mobile terminal that sends the first data from a radio-frequency identification tag to the data processing apparatus, and makes the radio-frequency identification tag to store the second data returned from the data processing apparatus;

a second mobile terminal that reads the second data from the radio-frequency identification tag, outputs the second data to a user of the second terminal, and causes the radio-frequency identification tag to store third data including an identifier of the user of the second mobile terminal and a current time when the second mobile terminal reads the second data from the radio-frequency identification tag; and a third mobile terminal that reads the third data from the radio-frequency identification tag and outputs the third data to a user of the third mobile terminal.

2. The data-management system according to claim 1, further comprising a sensor that senses surroundings and causes a radio-frequency identification tag to store sensing data as the first data.

3. A method for managing data related to disaster prevention installed in a facility, comprising:

storing first data related to a status of a disaster that has occurred in the facility and a second data that is related to an escape path from the facility in each radio-frequency identification tag of a plurality of radio-frequency identification tags;

sending the first data read from the radio-frequency identification tag to a data processing apparatus, determining the escape path from the facility based on the first data, by the data processing apparatus;

receiving the second data returned from the data processing apparatus and storing the second data in each radio-frequency identification tag, wherein the sending and the receiving are executed via a first mobile terminal;

reading the second data from the radio-frequency identification tag;

outputting the second data to a user of a second mobile terminal, wherein the reading of the second data and the outputting of the second data are executed by the second mobile terminal;

storing third data including an identifier of the user of the second mobile terminal and a current time in the radio-frequency tag, when the second mobile terminal reads the second data from the radio-frequency identification tag by the second terminal;

reading the third data from the radio-frequency identification tag; and outputting the third data to a user of a third mobile terminal.

4. The method according to claim 3, wherein the first data includes data output from a sensor that senses surroundings.

* * * * *